United States Patent [19]

Pelton

[11] Patent Number: 4,784,374

[45] Date of Patent: Nov. 15, 1988

[54] TWO-STAGE ALUMINUM REFINING VESSEL

[75] Inventor: John F. Pelton, Yorktown Heights, N.Y.

[73] Assignee: Union Carbide Corporation, Danbury, Conn.

[21] Appl. No.: 49,417

[22] Filed: May 14, 1987

[51] Int. Cl.[4] ..... C22B 21/06

[52] U.S. Cl. ..... 266/215; 75/68 R; 266/217; 266/229; 266/235

[58] Field of Search ..... 266/207, 215, 217, 225, 266/229, 227, 235, 286; 75/68 R

[56] References Cited

U.S. PATENT DOCUMENTS

| | | | |
|---|---|---|---|
| 3,311,363 | 3/1967 | Phillips et al. | 75/68 R |
| 3,743,263 | 7/1973 | Szekely | 75/68 R |
| 3,870,511 | 3/1975 | Szekely | 75/68 R |
| 4,021,026 | 5/1977 | Szekely | 266/215 |
| 4,040,610 | 8/1977 | Szekely | 266/235 |
| 4,203,581 | 5/1980 | Pelton | 266/217 |
| 4,290,588 | 9/1981 | Pelton | 266/235 |
| 4,372,542 | 2/1983 | Chia | 266/229 |
| 4,373,704 | 2/1983 | Pelton | 266/225 |

FOREIGN PATENT DOCUMENTS

| | | | |
|---|---|---|---|
| 2024261 | 1/1980 | United Kingdom | 266/215 |

*Primary Examiner*—L. Dewayne Rutledge
*Assistant Examiner*—Robert L. McDowell
*Attorney, Agent, or Firm*—Alvin H. Fritschler

[57] ABSTRACT

An aluminum refining vessel has two refining stages positioned side-by-side, with flow of molten aluminum into and out of the vessel being from the same side thereof. The vessel is readily adaptable for the reversal of flow therethrough, and for ease of installation, operation and maintenance.

18 Claims, 2 Drawing Sheets

FIG. 1
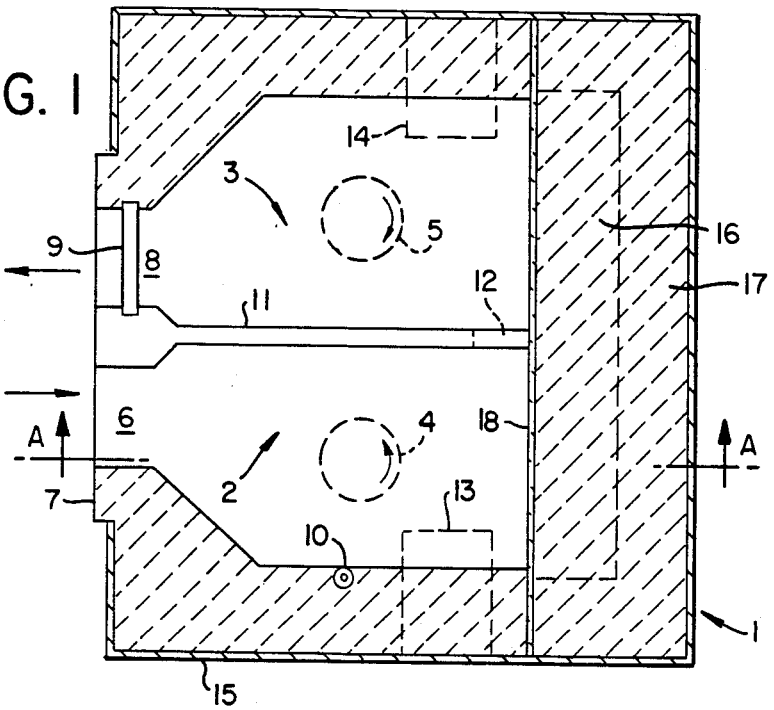
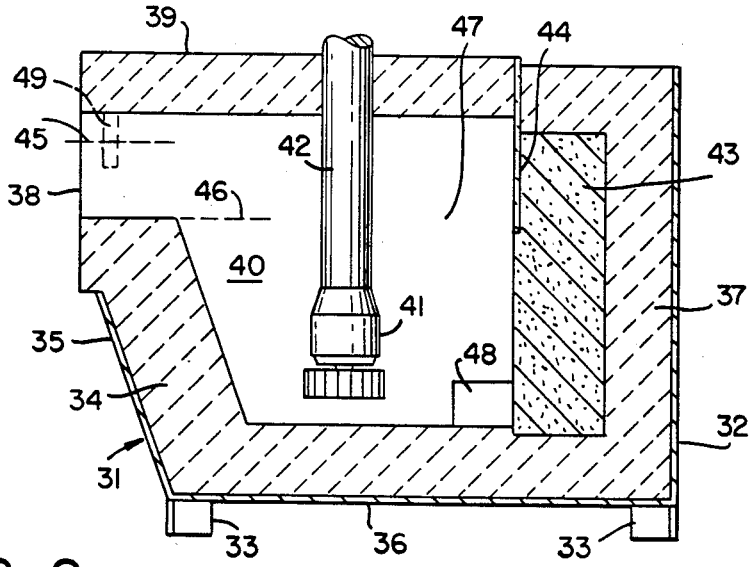
FIG. 2

TWO-STAGE ALUMINUM REFINING VESSEL

BACKGROUND OF THE INVENTION

1. Field of the Invention

This invention relates to the refining of aluminum. More particularly, it relates to an improved two-stage aluminum refining system.

2. Description of the Prior Art

Molten aluminum is commonly refined to remove dissolved hydrogen, non metallic particles and alkaline and alkaline—earth metals by sparging with a gas, such as argon or nitrogen, sometimes with the addition of chlorine. For maximum effectiveness and economy of gas usage, the sparging gas is dispersed in the form of fine bubbles. Such dispersion is advantageously accomplished by the use of a spinning nozzle for the injection of the sparging gas into the molten aluminum. This refining process can be carried out on a continuous or semi continuous basis in a flow-through system. When a fairly high aluminum refining capacity is required, i.e. usually above about 25,000 lbs./hr, it may be desirable to position two or more spinning nozzles in the refining vessel. If two spinning nozzles are used in a single enlarged chamber, the productive capacity of the vessel may be doubled compared to that achieved by the use of a single nozzle vessel. If, however, the nozzles are placed in separate compartments positioned adjacent to each other, in series, within the vessel, the capacity can be increased by a factor of two again compared with the capacity achieved using two nozzles operating within one chamber of the same total size. Such a two stage refining system, in which molten aluminum is passed into the inlet to the first stage at one end of the vessel and is removed from an outlet from the second stage at the, opposite end of the vessel, is further described and illustrated in the Pelton, U.S. Pat. No. 4,373,704. In this system, the separate compartments within the refining vessel are separated by a baffle adapted to enable molten metal flow to occur only from the first chamber to the second chamber, with no reverse flow from the second chamber to the first. It is possible, of course, to construct and use a system incorporating more than two such refining stages.

Aluminum refining systems having two or more stages will thus be seen to have the advantage of reduced size for any given refining capacity, together with enhanced refining effect per nozzle and volume of gas employed. In addition, such multi-stage systems offer opportunities for employing different refining gases in different refining stages. For example when a fairly large amount of chlorine is required for removal of alkaline and alkaline earth metals, all of the chlorine addition can be made in the first stage. Some of the chlorides thus formed in the first stage may be removed in the second stage. This result can not be achieved effectively in a single stage system, even when two injection nozzles are used therein.

The two stage system disclosed in said Pelton patent utilizes an externally heated cast iron tub with an interior lining and baffle means to create the two separate compartments. As illustrated in the drawings thereof, said stages are arranged in series with molten aluminum being passed into the bottom of the first stage at one end of the system, and removed from the top of the second stage at the opposite end of the system.

While the two stage system described above has significant advantages over a single stage system, there is, of course, a general desire in the aluminum refining art for further improvements, such as to provide for easier and more convenient installation, more compact design, particularly in light of the very limited operating space available at many refinery locations, ease of operation and maintenance, and the like.

It is an object of the invention, therefore, to provide an improved two-stage vessel for the holding and refining of aluminum.

It is a further object of the invention to provide a two stage refining system having simplified installation, operation and maintenance features thereof.

With these and other objects in mind, the invention is hereinafter described in detail, the novel features thereof being particularly pointed out in the appended claims.

SUMMARY OF THE INVENTION

The refining system of the invention comprises a two stage aluminum refining vessel in which the stages are positioned side-by-side and otherwise arranged for ease of installation, operation and maintenance. The improved construction is such that the flow direction through the vessel can readily be reversed, enhancing the flexibility of the vessel for use in aluminum refining facilities.

BRIEF DESCRIPTION OF THE DRAWINGS

The invention is hereinafter described in detail with response to the accompanying drawing in which:

FIG. 1 is a plan view of an embodiment of the refining system of the invention;

FIG. 2 is a cross sectional elevation view of the embodiment of the invention shown in FIG. 1, taken along line A—A of said FIG. 1;

DETAILED DESCRIPTION OF THE INVENTION

Figure 3:
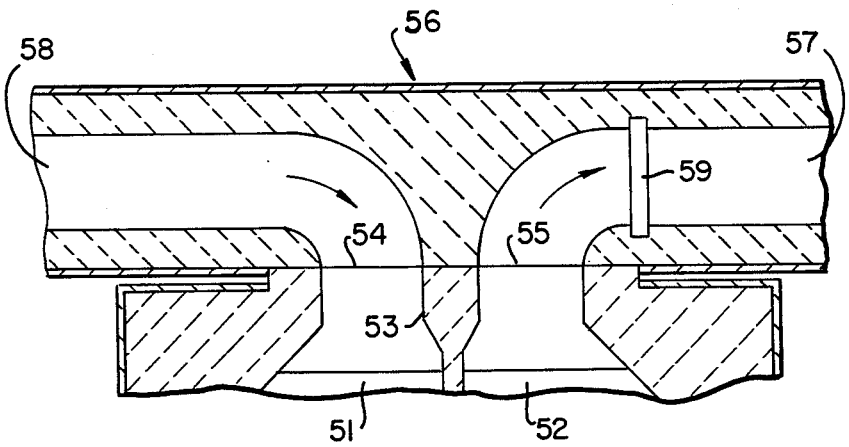
FIG. 3 is a schematic diagram of an exit baffle arrangement employed in one embodiment of the invention.

The objects of the invention are accomplished by providing a unique, two-stage refining vessel, providing enhanced convenience of installation, operation and maintenance. Thus, the two stages are arranged in a side by-side configuration, with molten metal passing into and out of the same end of the vessel, with no obstructions being positioned within each compartment apart from the spinning nozzle itself. The head drop during full flow operation is relatively low, and the ease of cleaning inherent in the design of the invention enables the head drop to be maintained at such low levels over the course of extended operation of the refining system in commercial aluminum refining applications.

The two stage, side-by-side arrangement of the invention will be seen in FIG. 1 of the drawings wherein the overall refining vessel, shown with its insulated cover removed, and represented by the numeral 1, comprises first stage compartment 2 and second stage compartment 3. Separate spinning nozzles (not shown) are provided for each stage, with the nozzle for the first stage being positioned at location 4 in compartment 2, and the nozzle for the second stage being positioned at location 5 in compartment 3. Inlet means 6 are provided in front end 7 of refining vessel 1 for the passage of the molten aluminum to be treated to first stage compartment 2, while outlet means 8 are provided for the discharge of refined molten aluminum from second stage compartment 3 at said front end 7. An outlet baffle 9 is positioned in said outlet means, said outlet baffle being shown in FIG. 2 to extend below the operating level of molten aluminum in said compartment 3 and outlet means 8 therein.

A temperature control thermocouple 10 is shown located in the outer side wall of compartment 2, it being understood that the providing of said thermocouple and the location thereof are desirable for convenience of operation, but are not essential features of the invention. Central baffle 11 is positioned between compartments 2 and 3 and forms the inner side walls thereof. Central baffle 11 has cross-over hole 12 positioned in the lower back corner thereof to provide fluid communication between the compartments for the flow of molten aluminum from the first stage to the second stage of the refining vessel. While the insulated cover of refining vessel 1 is removed in the FIG. 1 drawing, it should be noted that clean out hatches are conveniently provided therein, with the location of the hatch cover for compartment 2 being shown at location 13, and with the location of the hatch cover for compartment 3 being shown as location 14.

Those skilled in the art will appreciate that refining vessel 1 has an insulated shell 15 having bottom and side interior walls impervious to molten aluminum, and incorporating a graphite block lining 16 on at least one interior wall of the shell. In FIG. 1, the back end 17, i.e. the wall opposite front end 7 that contains inlet means 6 and outlet means 8, contains said graphite block lining 16, which extends above the design operating aluminum melt level within refining vessel 1 and is positioned so as to come into contact with the molten aluminum within said refining vessel 1. Graphite block 16 has an opening or openings (not shown) extending from the upper end thereof in the direction of, but not reaching, the bottom of the block. Electrical heating means (not shown) are disposed within said opening in the graphite block, with such heating means being supported in the opening without electrical contact with the graphite block. If the block were subjected to oxidation, the oxidized portion of the block would tend, in practice, to enlarge and extend down to below the level of molten aluminum in vessel 1. If this were to occur, molten aluminum would flow through the open spaces caused by the oxidation of the graphite and would attack the heating elements therein. In the preferred practice of the invention, refractory sheet 18 is used to protect the graphite block from oxidation by oxygen present in the gas phase above the level of molten aluminum in the vessel. As shown in FIG. 1, refractory sheet 18 desirably extends horizontally across compartments 2 and 3 to protect said graphite block 16 fully in the first and second stages of refining vessel 1.

The refining system of the invention is further illustrated in FIG. 2 with reference to the first stage of the refining vessel, represented generally by the numeral 31. An outer steel shell 32 with support means 33 has suitable insulation 34 impervious to molten aluminum positioned on the inner side thereof to form a front end 35, bottom 36 and back end 37 of said vessel 31. Molten aluminum inlet means 38 are provided on front side 35. Said front end 35, bottom 36 and back end 37, together with the outer side wall (not shown) and the inner wall discussed below will be understood to comprise first stage compartment 40, which will also have insulated cover 39 when in use for the refining of aluminum. This first stage compartment 40 will also contain a spinning nozzle assembly 41, including suitable drive shaft means 42 extending upward through said cover 39 to drive means (not shown) during aluminum refining operations.

On back end 37 of vessel 31, a graphite block lining 43 is positioned so as to come into contact with the molten aluminum on the vessel and to extend above the design operating melt level within vessel 31. As indicated above with reference to FIG. 1, said graphite block will be understood to extend across the back end 37 of first state compartment 40 and across the back end of the second stage compartment that is not shown in FIG. 2. To avoid oxidation of said graphite block 43, refracting sheet 44 is positioned on the inner surface thereof to protect said graphite block 43 from contact with oxygen in the gas phase above the level of the melt, i.e, molten aluminum, within refractory vessel 31. For this purpose the lower end of refractory sheet 44 extends not only to below the design operating level 45, but further to below the design idle level 46 within the vessel. Graphite block 43, as indicated above, desirably has an opening therein extending from the upper end thereof in the direction of, but not reaching, the bottom of the block, with electrical heating means supported in the opening without electrical contact with the graphite.

In said FIG. 2, a central baffle 47, corresponding to central baffle 11 of FIG. 1, is positioned so as to separate first stage compartment 40 from the side by side second stage compartment shown in FIG. 1. Cross over opening 48, preferably positioned in the lower back corner of said baffle 47 away from inlet means 38, provides means for molten aluminum to pass from said first stage compartment 40, following gas dispersion therein, to the second stage of the refining system of the invention. It will be understood that said cross over opening, or openings, is desirably positioned so that the top portion thereof is below the minimum design level of molten aluminum in the vessel, more desirably being positioned also on the portion of central baffle 11 near the back end of said first and second compartments, preferably near the bottom of said central baffle. The positioning of an outlet baffle corresponding to outlet baffle 9 in exit means 8 of FIG. 1 is illustrated by baffle means 49 in FIG. 2. The purpose of this outlet baffle, which extends below the molten aluminum level in the second stage compartment, is to prevent dross, which is removed from the molten aluminum and floats on the surface of the melt, from being carried along with the stream of molten aluminum removed from the second stage of the refining vessel.

While the outlet baffle is illustrated as being positioned in the exit means from the second stage compartment, it should be noted that said outlet baffle can be located at any other downstream location in the overall refining system. For example, said outlet baffle can also be positioned in the exit trough, in a position desirably close to the refining vessel as shown in FIG. 3. Such location allows ready access to the interior of the second state to be maintained for easy cleaning, an advantageous feature in the use of the refining vessel in continuous casting operations.

In said FIG. 3, first stage compartment 51, and second stage compartment 52, separated by central baffle 53 are indicated generally with respect to the front end of the refining vessel, at which molten aluminum enters the first stage through inlet means 54 and leaves the second stage through outlet means 55. In this advantageous refining system design, inlet and outlet troughs are conveniently located for side by side metal flow into and out of the front of the refining vessel. In FIG. 3, an overall trough assembly 56 is shown as positioned at the front of the refining vessel, said assembly comprising outlet trough 57 and inlet trough 58. Outlet baffle 59 is shown positioned in said outlet trough 57, desirably in proximity to outlet means 55 of the refining vessel.

A additional feature of the refining system of the invention is the operating flexibility obtainable by the convenient change in the flow direction of molten aluminum therethrough. For this purpose, it is only necessary to affect a simple change in the location of the outlet baffle in the illustrated embodiments. Thus, in the embodiments of FIG. 1, outlet baffle 9 can be moved to a similar position in the described inlet means 6, and the system can be operated with the flow of aluminum being into compartment 3, which is then the first stage, and out of compartment 2, which is then the second stage. Similarly, in the embodiment of FIG. 3, outlet baffle 59 can conveniently be moved to a similar location in trough 58, which then becomes an outlet trough as molten aluminum is passed to first stage 52 and is removed from second stage 51. Those skilled in the art will appreciate that the position of said outlet baffle can be changed without departing from the scope of the invention and that any other desirable means can be employed for holding back floating dross so as to preclude its retention by the product stream of refined aluminum.

In the plan view of FIG. 1, the nozzle rotation is illustrated as being counterclockwise in first stage compartment 2 and clockwise in second stage compartment 3. While such opposite rotations are generally preferred, satisfactory operation has also been achieved where both spinning nozzles are rotated in the same direction, either clockwise or counterclockwise.

Those skilled in the art will appreciate that various changes and modifications can be made in the details of the invention without departing from the scope thereof as set forth in the appended claims. Thus, spinning nozzle assembly 41 will be understood to be illustrative of any suitable gas distribution means known in the art and convenient for a given application. It is commonly preferred to employ a shaft driven rotating rotor, desirably having a stator fixedly attached to a protective sleeve surrounding the shaft with means being provided to introduce the gas into the space between said rotor and stator.

While any convenient materials of construction may be employed in the practice of the invention, the refractory sheet, i.e. said sheet 44 of FIG. 2, is desirably a ceramic fiber reinforced structural alumina available in sheet form. The vessel shell and support members employed in the practice of the invention are commonly of steel construction.

The compact design and inherent operating flexibility of the two stage refining vessel and system of the invention is particularly advantageous and desirable for practical commercial applications. As the available space in aluminum refining facilities is frequently very limited, the invention provides an advantage that is genuinely needed in the industry. The providing of a convenient and practical means for enabling molten aluminum flow in and out of the refining vessel from the same end thereof also is of significant advantage, providing easier and more convenient installation in most practical aluminum refining applications. The absence of obstructions within the vessel, apart from the spinning nozzles positioned therein for refining operations, and the convenient cross-over means for providing flow from one compartment to the other, render the refining vessel of the invention convenient to clean and maintain, such ease of cleaning enabling the head drop during full flow operation to be maintained relatively low, as indicated above.

Those skilled in the art will appreciate that the two stage refining vessel of the invention can be employed in conjunction with a variety of known refining techniques. While the invention is described above with reference to the placement of electrical heating elements within the graphite blocks described above, it will be appreciated that any other arrangement can be used for providing the necessary heat to the refining vessel without departing from the scope of the invention as set forth in the appended claims. The operating flexibility of the invention is of significance in the art, with the ability to change the flow direction through the vessel representing a particularly important feature in many practical commercial applications. In various aluminum refining facilities, the ability of a unit to flow molten aluminum in only one direction makes necessary vary appreciable, time consuming and costly adjustment of the molten aluminum flow arrangements, i.e. troughs and the like, to accommodate the limitations of the refining vessel. For suppliers of such vessels, such significant installation and operational problems can require that separate refining vessels be stocked and used depending upon the space and directional requirements and limitations of a particular refining facility. The invention obviates the need for such provisions and enables the direction of flow to be readily changed, typically by a simple change in the location of the exit stream baffle in the mouth of the exit or in the exit trough of the vessel. If other means are provided for preventing the dross from being carried away with the molten aluminum shown removed from the vessel, e.g. some other form of trough modification for this purpose, such other means can readily be located on the exit or downstream side for a desired flow direction, leaving the refining vessel of the invention readily adapted for the flow in that direction or in the reverse direction if such a further change were desired at a different time or at a different location within the refining facilities. The invention thus will be seen to represent a very valuable and desired improvement in the aluminum refining art.

I claim:

1. An improved two-stage aluminum refining vessel having an insulated shell with bottom and side walls impervious to molten aluminum, comprising:

(a) a central baffle member positioned so as to separate the space within said refining vessel into two aluminum refining compartment sections;

(b) a first stage aluminum refining compartment within said refining vessel and having a front end, back end and an outer side wall, said central baffle member comprising the inner side wall of said first stage aluminum refining compartment, which is capable of receiving a first spinning nozzle assembly for the injection of sparging gas into molten aluminum during aluminum refining operations in said refining vessel;

(c) inlet means located at the front end of said first stage aluminum refining compartment for introducing molten aluminum thereto;

(d) a second stage aluminum refining compartment within said defining vessel and having a front end, back end and outer side wall, said central baffle member comprising the inner side wall of said second stage aluminum refining compartment, which is capable of receiving a second spinning nozzle assembly for the injection of sparging gas into molten aluminum during aluminum refining operations in said refining vessel, said first and second stage aluminum refining compartments thus being positioned in a side-to-side relationship within the refining vessel, the front end of said second stage aluminum refining compartment being located at the same side of the vessel as said front end of the first stage aluminum refining compartment;

(e) outlet means located at the front end of said second stage aluminum refining compartment for withdrawing molten aluminum therefrom;

(f) a cross-over opening in said central baffle member to enable passage of molten aluminum therethrough from said first stage aluminum refining compartment to said second stage aluminum refining compartment during continuous aluminum refining operations within said refining vessel, said first and second stage aluminum refining compartments being essentially free of obstructions apart from the spinning nozzle assemblies positioned therein during the refinery operations; and (g) means for separating floating dross from the molten aluminum stream that is treated in said refining vessel, whereby said two-stage refining vessel is desirably compact, convenient to install and operate, and free of obstructions apart from the gas distribution means employed therein upon use of said vessel in aluminum refining operations, said vessel being such that the flow direction through the system can readily be reversed.

2. The apparatus of claim 1 in which said cross-over opening on the central baffle is positioned so that the top portion thereof is below the minimum design operating level of molten aluminum in the vessel.

3. The apparatus of claim 2 in which said cross-over opening is positioned on the portion of said central baffle near the back end of said first and second compartments.

4. The apparatus of claim 3 in which such cross-over opening is positioned near the bottom of said central baffle in the portion thereof near the back end of said first and second compartments.

5. The apparatus of claim 4 in which said cross-over opening comprises a single opening in said central baffle.

6. The apparatus of claim 1 in which said means for separating floating dross from the molten aluminum stream that is treated in the vessel comprises baffle means extending from above the level of said molten aluminum stream to below the level thereof, said baffle means serving to hold back said floating dross and prevent its being carried along with the molten aluminum stream.

7. The apparatus of claim 6 in which said baffle means are positioned in the outlet means from the second stage compartment of the vessel.

8. The apparatus of claim 6 and including an inlet trough for passing molten aluminum to the inlet means to said first stage compartment, and an outlet trough for removing molten aluminum from the outlet means from said second stage compartment.

9. The apparatus of claim 8 in which said baffle means are positioned in said outlet trough.

10. The apparatus of claim 1 and including gas distribution means for distributing sparging gas in the molten aluminum in the first and second stages of said refining vessel.

11. The apparatus of claim 10 in which said gas distribution means comprise spinning nozzle assemblies, a spinning nozzle assembly being positioned in each of said stages of the refining vessel.

12. The apparatus of claim 1 in which at least one interior wall of each compartment has a graphite block lining thereon, said graphite block extending above the design operating melt level within the vessel, said graphite block being positioned so as to come into contact with the molten aluminum within the compartment and including electrical heating means positioned within said graphite block.

13. The apparatus of claim 12 and including a refractory sheet positioned in the inner surface of the graphite block and extending vertically so as to protect said graphite block from contact with oxygen in the gas phase above the level of molten aluminum within the compartment, said refractory sheet extending horizontally substantially to both sides of the shell for purposes of totally protecting said graphite from oxidation.

14. The apparatus of claim 13 in which said cross over opening in the central baffle is positioned so that the top portion thereof is below the minimum design operating level of molten aluminum in the vessel.

15. The apparatus of claim 14 in which said cross-over opening is positioned in the portion of the central baffle near the back end of said first and second compartments and near the bottom of said central baffle.

16. The apparatus of claim 15 in which said means for separating floating dross comprises baffle means extending from above the level of said molten aluminum stream to below the level thereof.

17. The apparatus of claim 16 in which said baffle means are positioned in the outlet from the second stage compartment of the vessel.

18. The apparatus of claim 16 in which said baffle means are positioned in an outlet trough for the removal of molten aluminum from the second stage.

* * * * *